US005927735A

United States Patent [19]

Hosoda

[11] Patent Number: 5,927,735

[45] Date of Patent: Jul. 27, 1999

[54] TRANSPORTATION DEVICE

[76] Inventor: Kiyoyuki Hosoda, 733-3, Ohaza Meisei, Misato-mura, Minamiazumi-gun, Nagano 399-8101, Japan

[21] Appl. No.: 09/059,337

[22] Filed: Apr. 14, 1998

[30] Foreign Application Priority Data

Jun. 10, 1997 [JP] Japan ..... 9-151918

[51] Int. Cl.[6] ..... B62M 1/00; A63C 5/08

[52] U.S. Cl. ..... 280/87.042; 180/181

[58] Field of Search ..... 280/87.042, 87.041; 180/180, 181, 65.1, 65.6, 65.7, 272; 56/11.3, 10.5

[56] References Cited

U.S. PATENT DOCUMENTS 4,842,091 6/1989 Badsey ..... 180/219
5,775,452 7/1998 Patmont ..... 180/181
5,809,755 9/1998 Velke et al. ..... 56/10.8

FOREIGN PATENT DOCUMENTS 6-23087 2/1994 Japan .

*Primary Examiner*—Lanna Mai
*Assistant Examiner*—Faye M. Fleming
*Attorney, Agent, or Firm*—Burns, Doane Swecker & Mathis LLP

[57] ABSTRACT

The transportation device according to this invention has the brake device that is released when the control lever is held. Thus the brake device can be used to stop the transportation device and as a parking brake. The transportation device according to this invention is safe because it does not start unless the control lever is operated. If the user, while running the transportation device in a wasteland and the like, is thrown out of the transportation device and releases the control lever, the brake functions automatically and the engine output decreases. Thus the transportation device can be stopped without fail, and dose not run uncontrollably.

10 Claims, 4 Drawing Sheets

TRANSPORTATION DEVICE

BACKGROUND OF THE INVENTION

1. Field of the Invention

This invention relates to a transportation device having a brake device, and more particularly to a simple transportation device such as a skateboard like transportation device.

2. Description of the Related Art

Simple transportation devices such as a bicycle and a motorcycle have a brake that can be operated by hand, and rider applies the brake by holding a lever with his or her hand.

There has known a skateboard on whose board (deck) supported by rollers riders (users) can put their feet, and which they can advance in a desired direction keeping their balance. This type of skateboard does not have a brake being operated by hand.

Simple transportation devices are being developed which can be used as personal transportation means or sport apparatus or leisure equipment. Such as a transportation equipment like a skateboard on which a drive device like an engine is mounted, for example, is under developed, and which is thereby enabled to run automatically and easily even on a plane. And a transportation equipment having a frame of simple structure on which an engine is mounted, and which is thereby enabled to run automatically. For such transportation devices to be used safely, the devices should preferably have a brake device.

An object of this invention is to provide a transportation device having a safe brake device of simple structure appropriate for those simple transportation devices. An another object of this invention is to provide a transportation device having a brake device which can prevent the transportation device from running uncontrollably. And hence to keep the safety even when the rider should leave unwillingly and/or unexpectedly from the transportation device by failing in shifting their weight or in operating and the like.

SUMMARY OF THE INVENTION

An transportation device according to this invention is provided with a control lever which can control the brake device in a way that the brake is released when the control lever is held and the brake is applied when the control lever is released (open or not held). The control lever of this invention functions contrary to a conventional brake lever of a bicycle and the like. That is, the transportation device according to this invention comprises a plurality of wheels placed in front and in rear; a frame body supported by these wheels on which at least one rider can ride; a brake device which can brake a speed of at least one of the wheels; and a control lever which can control the brake device such that the brake device is released when the control lever is held. In the transportation device according to this invention, if the riders (users) should leave the transportation device unwillingly, such as when they fail in shifting their weight while skateboarding, and they release the control lever, the brake works automatically. Therefore, it becomes possible to prevent the transportation device from running without control by the user. This function is appropriate for a simple transportation device used in sports or leisure such as a skateboard which runs by manually or automatically, or as a transportation device which is used to run on a rough road or a steep slope. By applying the brake system of this invention, users can enjoy riding on them more safely.

As the brake works automatically when the user release the control lever, the transportation device stops automatically near where the user leaves the device. The user need not chase the transportation device and can recover it easily. Particularly, simple transportation devices such as a three-wheeled vehicle or a four-wheeled vehicle are stable unlike a two-wheeled vehicle such as a bicycle, and are likely to run away by inertia or engine power even without a user. Thus, the transportation device can prevent running uncontrollably by providing the brake system according to this invention which works when the control lever is open, released or not held.

As the transportation device according to this invention has the brake system that works when the control lever is released, it does not move even on a slope and the like unless the control lever is held. Thus the brake system can be used as a parking brake as well.

The control lever according to this invention can be used for governing a drive device which can drive at least one of the wheels, in which case the number of revolutions (speed) of the drive device is preferably increased when the control lever is held. This control system enables the brake to be released when the control lever is held and then increase the number of revolutions of the drive device so that the transportation device starts. This control system also enables the brake to be applied when the control lever is released or loosened (let go) and then decrease the number of revolutions of the drive device so that the brake works and the transportation device stops. And it is possible to accelerate or decelerate the transportation device by holding the control lever in an appropriate position. In sum, it is possible to start, accelerate, decelerate or stop the transportation device by means of the single control lever. As a result, it is possible to provide a simple control system of the brake device and the drive device appropriate for a simple transportation device.

Although the brake device can be attached on each wheel, it is preferable to dispose the brake device on a transmission path through which driving force is transmitted from the drive device to the wheels. By placing the brake device as close as possible to the drive device, it is possible to simplify the structure of the wheels and the surroundings thereof. In addition, if the brake device is placed close to the drive, it becomes easy to control both the devices together as described above.

For a transportation device which often runs on a slope, and the like, a one-way clutch placed in the transmission path is effective. In this case it is preferable to provide the one-way clutch on the side of drive device with respect to the brake device so that the clutch may not invalid the function of brake device. And it is possible to provide a centrifugal clutch in the transmission path on the side of the drive device with respect to the brake device. By the centrifugal clutch, the driving force transmits smoothly to the wheels when the control lever is held and the speed the drive device is increased.

By setting at least one footboard on the frame body of the aforementioned transportation device, it becomes possible for the rider to stand on the transportation device and to control the course of the frame body by shifting his or her weight. In addition, it is preferable that the control lever be supported by a flexible member extending above the frame body to enable the user standing on the transportation device to control the brake and the engine holding the control lever in a comfortable position.

DESCRIPTION OF THE PREFERRED EMBODIMENT

Figure 1:
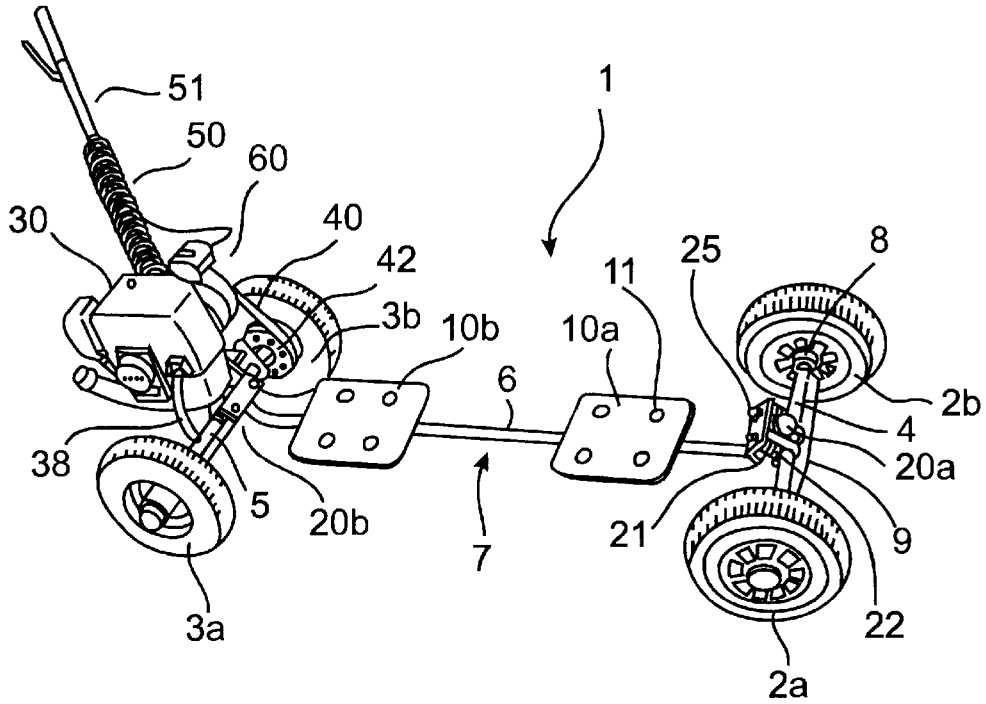
FIG. 1 is a perspective view of the stand-on transportation device of an embodiment of this invention.
Figure 2:
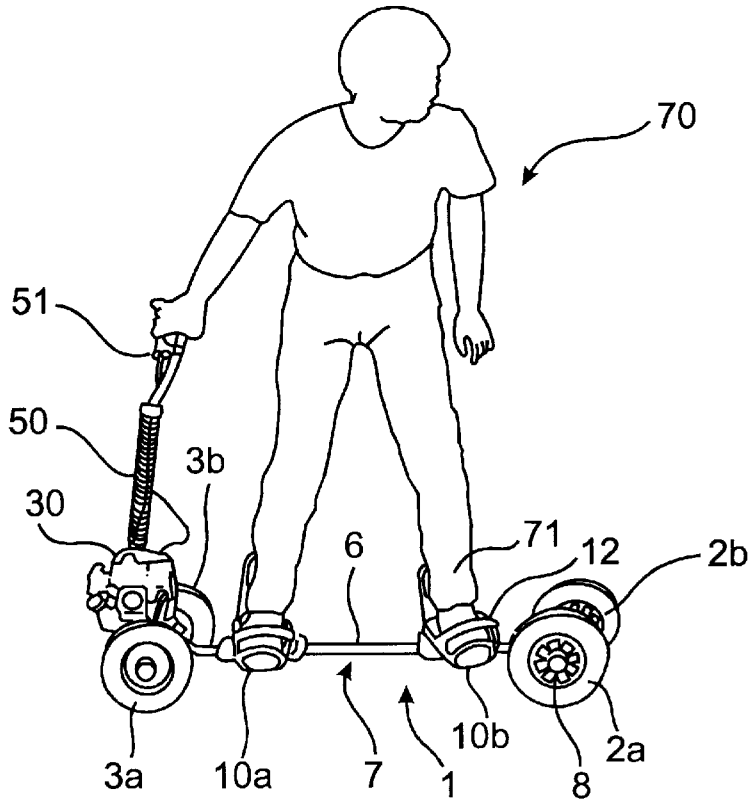
FIG. 2 shows the state in which the rider (user) stands on the transportation device shown in FIG. 1.
Figure 3:
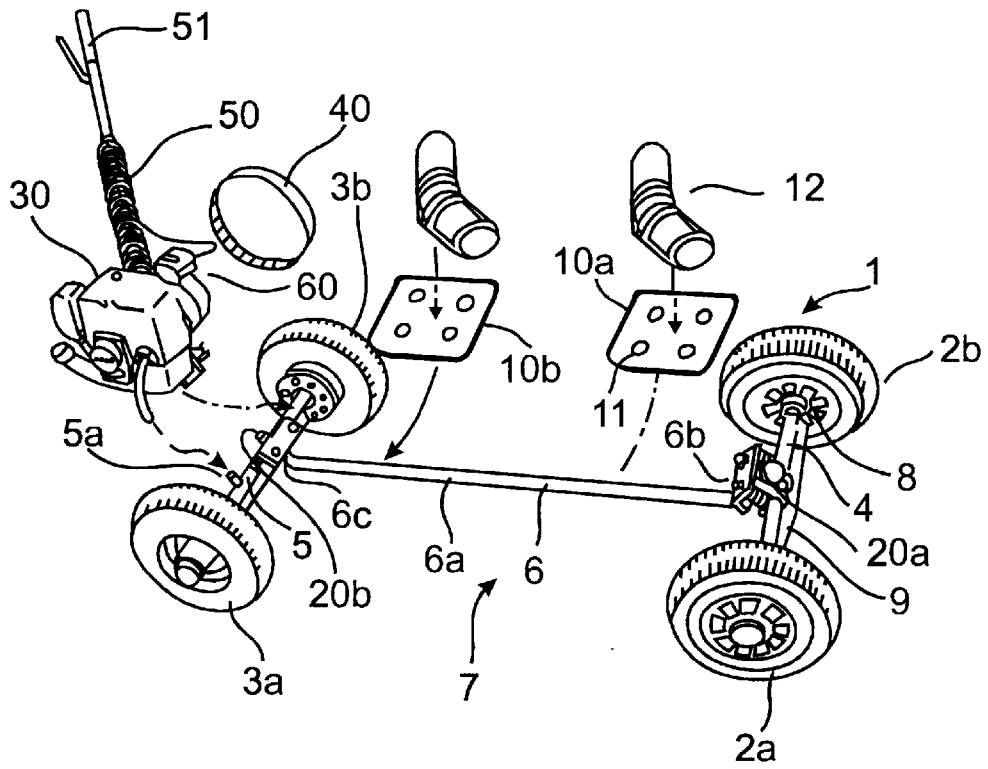
FIG. 3 is an exploded perspective view of the main members of the transportation device shown in FIG. 1.

FIG. 1 is a schematic view of a transportation device according to this invention, and FIG. 2 shows how a user rides on a transportation device 1. And FIG. 3 is an exploded view of the schematic configuration of the transportation device 1 of this embodiment. The transportation device 1 of this embodiment comprises two pairs of wheels 2*a* and 2*b*, 3*a* and 3*b* placed in front and in rear; pipe-shaped shafts 4 and 5 connecting these pairs of wheels respectively; and a pipe-shaped frame 6 connecting the shafts 4 and 5. These two shafts 4 and 5, and the frame 6 are combined in approximately "H" shape to form a frame body 7. Footboards 10*a* and 10*b* are attached to the frame 6 on which a user (rider) can put user's feet. Thus the user standing on the transportation device can run it changing the course by shifting the weight.

A small gasoline engine 30 having the displacement of about 30 to 50 cc, but not limiting the size of engine for this invention, is mounted on the rear shaft 5 of the transportation device 1. The rotational force of the engine 30 is transmitted to the rear wheel 3*b* through a driving belt 40, and the driving force of the engine 30 enables the transportation device 1 to run. A supporting member 50, which can move flexibly by means of a flexible tube or coiled metal members, extends above the engine 30. A control lever 51 is located on the tip of the supporting member 50, which enables the user to operate the engine 30 standing on the frame 6.

Figure 4:
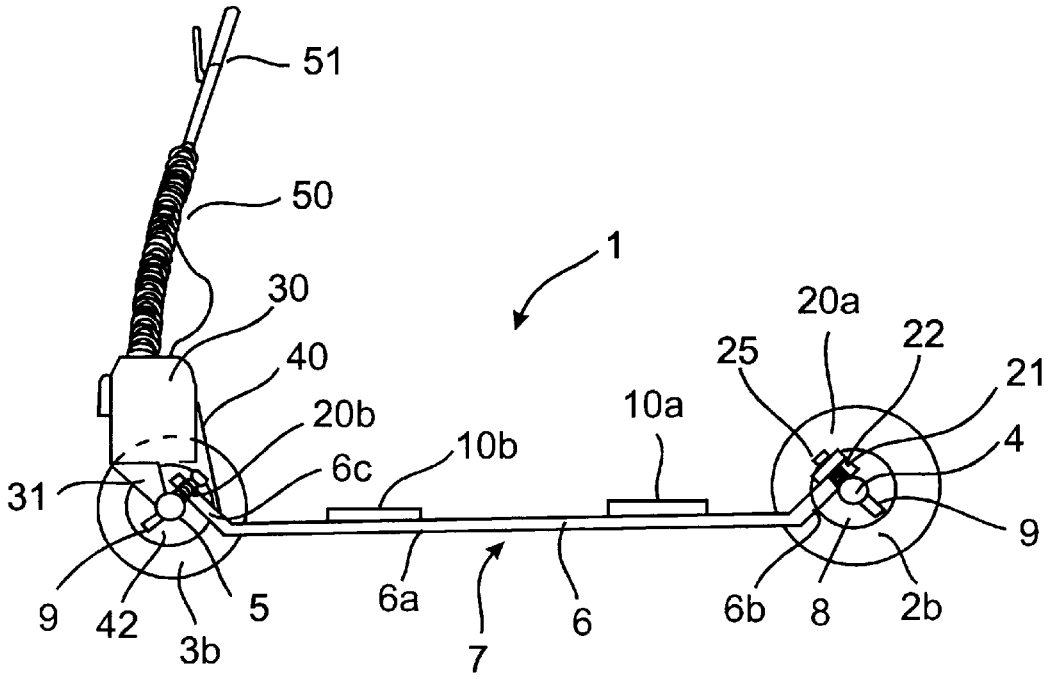
FIG. 4 is a longitudinal view of the transportation device shown in FIG. 1.

The frame 6 extending longitudinally connects the middle of the shafts 4 and 5. The frame 6 is made of a pipe-shaped member whose middle portion 6*a* extends horizontally. The front end 6*b* and the rear end 6*c* of the frame 6 incline upward at an angle of approximately 45 degrees to the horizontal middle portion 6*a*, and are connected to the shafts 4 and 5. Accordingly, as the longitudinal view of the transportation device 1 in FIG. 4 shows, the frame 6 is positioned lower than the shafts 4 and 5, which makes it possible to form the stable frame body 7 whose center of gravity is lower. Since the shafts 4 and 5 can be set higher than the frame 6, it is possible to fix a wheel with a large diameter without heightening the center of gravity of the frame body. Therefore, the transportation device 1 can run even on a rough road smoothly.

Holders 12 for holding the feet 71 of the user 70 in an appropriate position can be fixed to the front and rear footboards 10*a* and 10*b* mounted to the middle portion 6*a* of the frame 6. For that purpose, fixing holes 11 are made in the footboards in a way that the holders 12 may be attached at an appropriate angle. Accordingly, the user can attach the holders 12 to the footboards 10*a* and 10*b* at an angle convenient to them, and then ride on the transportation device 1 putting their feet 71 inside the holders 12. The user can adjust the load balance applied to the frame 6 and the shafts 4 and 5 by shifting the weight right and left or in any other appropriate direction standing on the footboards 10*a* and 10*b*. Thus the user can advance the transportation device 1 as they likes.

In the transportation device 1 of this embodiment, the frame 6 is joined to the shafts 4 and 5 through connectors 20*a* and 20*b* which move elastically so that the movement of the frame 6 can be transmitted smoothly to the shafts 4 and 5. And the shafts 4 and 5 can rotate at an appropriate angle as the user shifts the weight. The connectors 20*a* and 20*b* of this embodiment connect the frame 6 to the shafts 4 and 5 have the same structure. Springs 21 and dampers (shock absorbers) 22 are positioned on the right and left of the frame 6, through which the shafts 4 and 5 and the frame 6 are joined. Accordingly, if the user standing on the footboards 10*a* and 10*b* of the frame 6 shifts the weight right and left to cause the frame 6 to twist. Then, the connecting part 6*b* of the frame 6 which extends at an angle of almost 45 degrees rotates, and one of the springs 21 shortens while the other lengthens accordingly. Therefore, the shafts 4 and 5 rotate toward the loaded side (the side on which the user's weight is rested) according to the force given by the springs 21, and thus it becomes possible to advance the frame body 7 in a desired direction. Thus, as in the case of a skateboard and a snowboard, it is possible for the user to change the course of the transportation device 1 of this embodiment by weight shifting. And the dampers 22 can prevent the reaction of the springs 21 caused by the shift of weight. Therefore it is possible to change the course smoothly even on a zigzag road.

The connectors 20*a* and 20*b* also absorb the impact caused by the roughness of a road and the like. The combined springs 21 and the dampers 22 can absorb the impact flexibly so that the shake of the transportation device may be reduced. Therefore, even if the user runs the transportation device on a rough road, goes over a difference in level, or rounds a curve, the user standing on the footboards 10*a* and 10*b* is little affected and thus can enjoy riding on the transportation device stably and comfortably. The properties of the springs 21 and the dampers 22 can be adjusted by a bolt 25 by which the springs 21 and the dampers 22 are attached. And the joining of the frame 6 and the connectors 20*a* and 20*b* can be adjusted by a sliding member such as a rubber packing inserted in the portion where the tip of the frame 6 is attached to the connectors 20*a* and 20*b*. Accordingly, the running properties of the transportation device 1 can be adjusted by the movement of the adjusting bolt 25 and the like, and can be determined depending on the user's taste and the road conditions.

Figure 5:
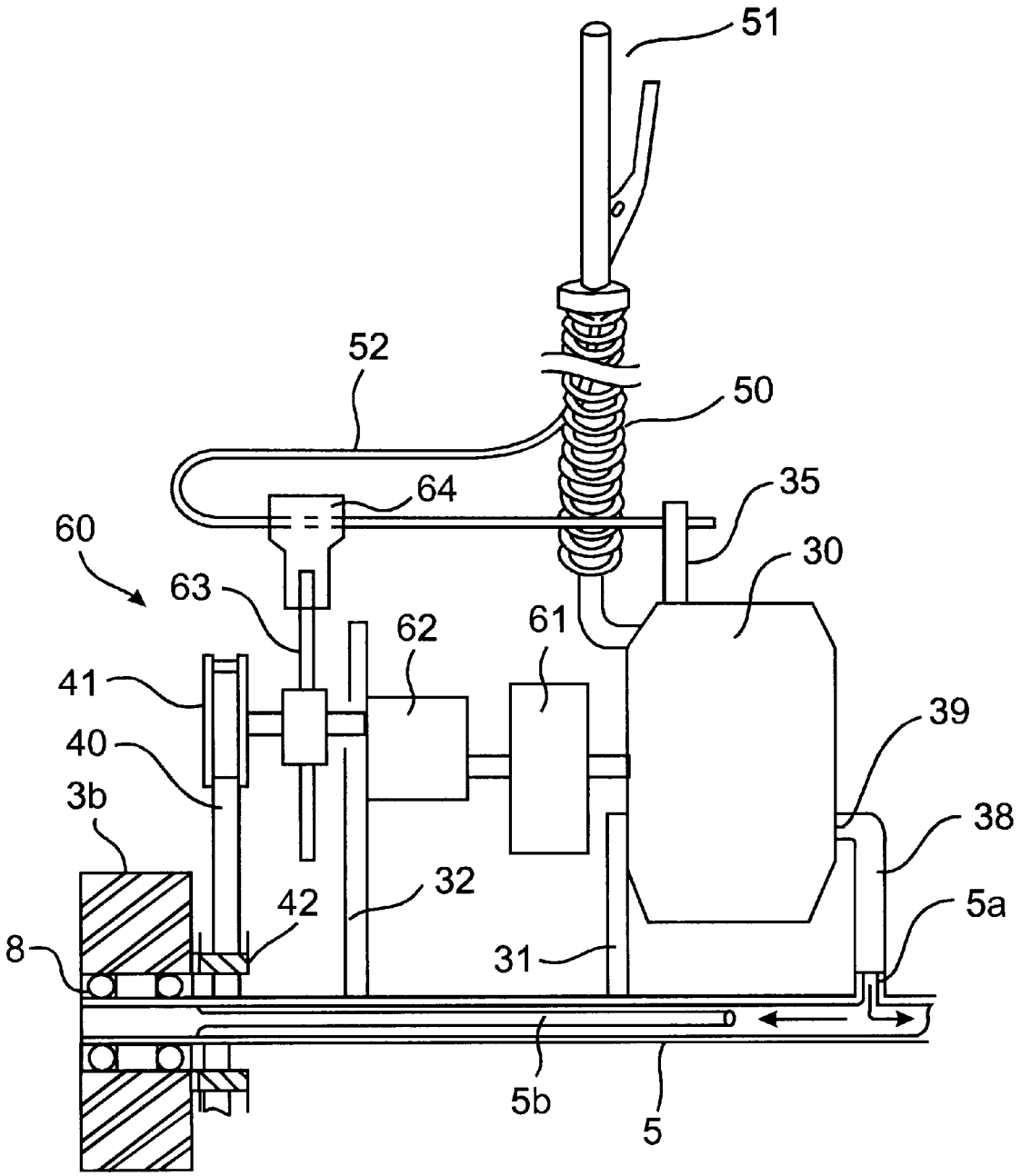
FIG. 5 is a schematic view of the surrounding configuration of the engine of the transportation device shown in FIG. 1.

FIG. 5 schematically shows the surrounding configuration of the engine 30 fixed on the transportation device 1 of this embodiment. The transportation device 1 has the gasoline engine 30, which is mounted to the rear shaft 5 by a support plate 31. The rotational force of the engine 30 is transmitted to one of the wheels 3*b* of the shaft 5 through a transmission 60 comprising a centrifugal clutch 61 which is connected when the number of revolutions increases; a one-way clutch 62 which transmits only forward driving force; a disc brake 63; and a driving belt 40. The transmission (transmission path) 60 having these centrifugal clutch 61, one-way clutch 62, disc brake 63, and driving belt 40, and a pulley 41 which rotates the driving belt 40 is also mounted to the rear shaft 5 by a support plate 32. This shaft 5 is connected with an exhaust port 39 of the engine 30, and is used as an exhaust pipe having a function of muffler. A connecting port 5*a* is prepared in the shaft 5 for connecting the exhaust port 39 of the engine by a vinyl pipe 38. A thin tube 5*b* is inserted in the shaft 5 to make the shaft 5 function as a chamber as well, which improves muffling efficiency.

As is described above, in the transportation device 1 of this embodiment, both the engine 30 and the transmission system 60 are attached to the rear shaft 5, and the wheel 3*b* of the rear shaft 5 is driven as a power wheel. Therefore, when the user riding on the frame 6 shifts the weight to cause the shaft 5 to rotate, the engine 30 and the transmission system 60 as well as the wheel 3*b* move according as the shaft 5 moves. So, the relative position of the wheel 3*b* with respect to the engine 30 and the transmission system 60 does not change, and thus the driving force of the engine 30 can be transmitted stably and/or continuously to the wheel 3*b*. As the wheel 3*b* is rotated by the driving belt 40 fixed on a passive pulley 42 attached to the wheel 3*b*, the wheel 3*b* and the shaft 5 can be joined extremely simply through a bearing 8, and the shaft 5 need not be rotated like a drive shaft. Therefore, it is possible to load the weight of engine 30 and the transmission system 60 directly on the shaft 5. It is possible to form the simple, light frame body 7 which can be operated comfortably and can be produced at a small cost, by connecting the shaft 5 and the frame 6 by means of the connector 20*b* as described above.

Furthermore, the brake 63 of this transportation device 1 is disposed not on the wheel 3*b* but in the path through which the power from the one-way clutch 62 is transmitted to the driving belt 40. Therefore the braking function can be added with the surrounding configuration of the wheel 3*b* kept simple, and it is possible to provide the safe transportation device 1 at a small cost without sacrificing the operating (steering) performance. That is, it is possible to add a braking function without placing a new brake or wire in the frame body 7 nor the wheels and the surroundings thereof, by placing a brake 63 (braking device) in the power transmission path 60 to be installed near the drive device. Accordingly, this method of fitting the braking device to the power transmission system is appropriate for a simple transportation device such as the transportation device 1 of this embodiment. Not only in the transportation device of this embodiment but also in a simple transportation device such as a skateboard on which an engine unit is added, it is possible to provide the braking function easily disposing the brake on the side of engine of the transmission path to be added with the engine unit together. And user can use the braking function. It is preferable to install the brake device down stream of the one-way clutch, if applied, for valid the brake function. That is, the one-way clutch should be located on the side of engine unit with respect to the brake device in the transmission path. By this arrangement, both the one-way clutch 62 and brake device 63 can provide in the transmission path 60.

The disc brake 63 of the transportation equipment 1 of this embodiment is operated by means of a control wire 52 extending from a control lever 51 supported above the engine 30 by a flexible member 50 to a brake pad 64. When the control lever 51 is released or loosened, the brake 63 works to stop the wheel 3*b*, while when the control lever 51 is held, the brake 63 is released and the wheel 3*b* begins to move. Accordingly, unless the user operates the control lever 51, the brake 63 is not released and the transportation device 1 does not start by itself. Therefore, the frame body 7 does not move itself even on a slope, the brake 63 functions as a parking brake as well. As the brake 63 always works unless the user operates it, the user never forgets to apply the brake. Moreover, if the user standing on the frame 6 loose or release the control lever 51 due to such as losing their balance or by mistake, the control wire 52 is released. Then, the brake pad 64 is moved or shut by springs and the like, and the brake works automatically. Thus the transportation device 1 is prevented from running uncontrollably, and will be used safely as sport apparatus or leisure equipment. The user can enjoy riding on it even in places where it is difficult to run on it stable, such as a rough road or a steep slope. If the user leaves the transportation device 1 willingly or unwillingly when they lose their balance or for other reasons, the brake works and stops the transportation device 1 near where the user left it. Accordingly, it is easy to recover the transportation device 1.

As is description, the brake device 63 of this embodiment can function as a normal stopping or decelerating brake, as a parking brake, and further as an emergency brake, by employing the control lever 51 which releases the brake when held. As a single brake system can cover these functions, the brake system can be simplified, and it becomes possible to realize a high-function brake system appropriate for a simple transportation device at a small cost. It is possible to further improve the reliability of breaking system of this embodiment by the means such as doubling the disc brake.

The control wire 52 extending from the control lever 51 is also connected with a throttle control lever 35, a governing control mechanism of the engine 30. When the control lever 51 is held, the number of revolutions (speed) of the engine 30 increases, while when the control lever 51 is released or loosened, the number of revolutions of the engine decreases. Thus in the transportation device 1 of this embodiment, when the control lever 51 is held, the brake 63 is released and the speed of the engine 30 increases. Then the centrifugal clutch 61 is connected and engine power is transmitted to the wheel 3*b*, thus the transportation device 1 moves. On the other hand, when the control lever 51 is released or loosened, the speed of the engine 30 decreases, and the centrifugal clutch 61 becomes disconnected. Therefore, the power of the engine is not transmitted to the wheel 3*b* and the brake 63 works thus the transportation device 1 stops. If the user is thrown out of the transportation device and releases the control lever 51, the output of the engine 30 decreases automatically and the brake 63 works at the same time. As a result, the transportation device will stop without fail.

In the transportation device 1, as described above, the brake device (brake) 63 is provided in the transmission path 60, and the engine 30 and the brake 63 are placed close to each other. Therefore, a common part of the control path leading from a single control lever can be laid to the neighborhood of the engine 30 and the brake 63. This means that the arrangement of the engine and brake of this embodiment is suitable for the control system having interlock between engine and brake by means of a single control lever. For instance, as in this embodiment, it is possible to connect the brake 63 and the throttle control lever 35 of the engine by means of the single control wire 52 led to the control lever 51. By such a simple configuration, the brake 63 and the throttle control lever 35 are interlocked by means of the control lever 51. It is also possible to connect the brake 63 and the control mechanism of the engine 30 through an appropriate link and the like. It is possible to design and/or provide the engine 30 and the transmission path 60 including the brake mechanism 63 as a power unit to be adding on some equipment as a new component. And because the single control lever 51 can control all of function included in that unit, user can control that add-on power unit extremely easily.

Figure 6:
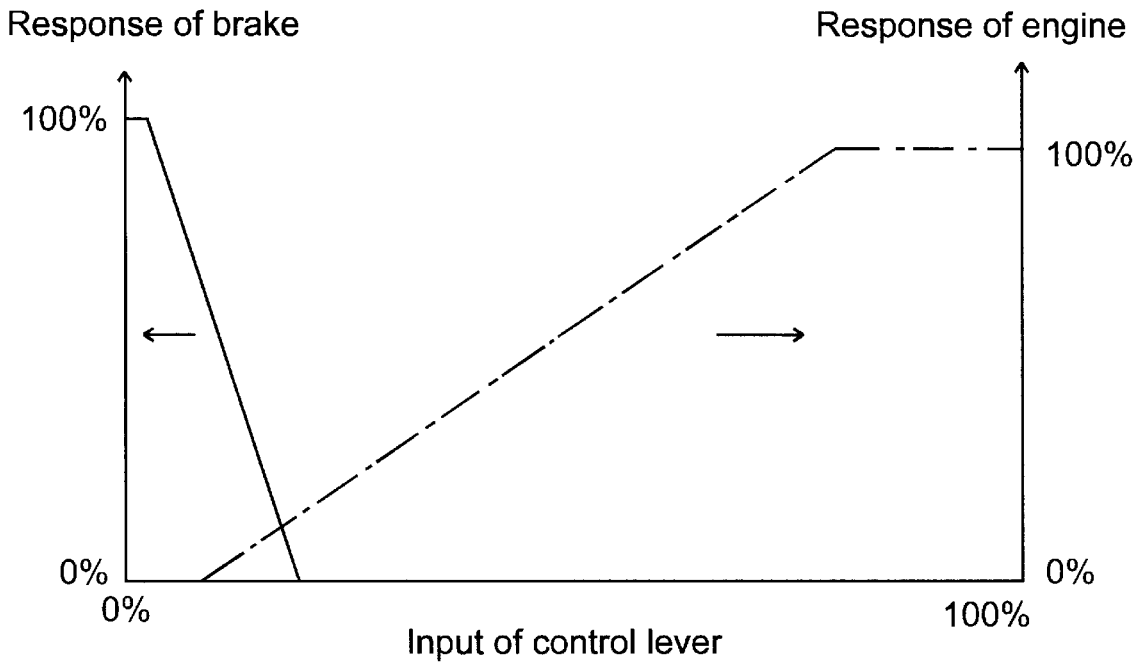
FIG. 6 is a graph illustrating the response of the control lever with respect to the brake and the engine.

FIG. 6 schematically shows the response of the brake 63 and the engine 30 to the control range of the control lever 51.

When the control lever 51 is not operated, that is, when the user is not on the transportation device 1, or when the user holds the control lever 51 only lightly and the lever 51 is almost released or loosened, 100% brake force can be obtained. As the control lever becomes held and input of the control lever 51 is increased, the braking force of the brake 63 gradually decreases. The engine 30, on the other hand, idles when the control lever 51 is not operated, and thus the centrifugal clutch 61 does not transmit power via the transmission path 60. If the control input of the control lever 51 is increased, the number of revolutions (speed) of the engine 30 increases, and the centrifugal clutch 61 is connected at an appropriate control input and transmits the power of engine via the transmission path 60.

If the control input of the control lever 51 is increased further, the braking force of the brake 63 becomes 0%. Thereafter the input of the engine 30 increases according to the control input of the control lever 51, and it is possible to drive the transportation device 1 at an appropriate speed. Therefore, it is possible to control the brake 63 and the number of revolutions (output of the engine) of the engine 30 at will by changing the grip amount (control input) of the control lever 51. Thus in the transportation device 1 of this embodiment, an accelerator and the brake system can be easily operated only by means of the control lever 51.

Accordingly, the user can use one hand to operate the engine and the brake, the other hand to shift the weight or to keep the balance and for other purposes. The control system of this invention is particularly suitable for the transportation device such as that the steering will be controlled by the weight shift of the rider (user). In addition, in the transportation equipment 1 of this embodiment, the control lever 51 is supported by the flexible member 50 at a convenient height in a way that the user standing on the transportation device. Therefore, user can hold the control lever with their hand easily and they can shift their weight standing and holding the control lever 51 in their hand. Moreover, as the control lever 51 can be moved freely in a certain range by the flexible member 50, the user can control the transportation device 1 at will in a comfortable position as they like. Since the flexible member 50 supports the load of the control lever 51, the burden to the user's arms and their fatigue will be reduced.

The operation of the brake and the accelerator by means of the control lever as described above is useful not only in a simple transportation device using the weight shift for steering as the above, but also in other types of transportation devices. For example, in a transportation device whose course is controlled by the operation of the handlebar, by fitting the aforementioned control lever to the handlebar, it is possible to control the brake, the accelerator, and the course with one hand. The response properties of the control lever, the brake and the accelerator are not limited to those shown in FIG. 6, and the properties of the brake and the accelerator with respect to the control input need not change linearly. In FIG. 6, there is an area where both braking force and driving force can be obtained so that the transportation device can be started smoothly. It is possible to dispense with such an area, which is appropriate when the user slides down a slope using a one-way clutch, and in other cases. And the response properties of the brake and the engine with respect to the control input of the control lever can be changed at will.

The transportation device 1 described above, like a skateboard and a snowboard, can steer at will by the shift of the rider's weight. And as the user can control driving force and braking force by means of the control lever 51, they can run the transportation device at will on a plane or even an ascending slope by shifting their weight. In addition, as the brake works when the control lever 51 is released, the transportation device 1 does not run uncontrollably even if the user get off unexpectedly. Therefore, the transportation equipment of this invention suits running in rough places such as a steep slope, a rough road, or a wasteland. User can use them as sports or leisure purpose and enjoy running safely in such places. The transportation device 1 of this invention can be used as leisure equipment or a sport apparatus for users who enjoy snowboarding in winter for enjoy the same feeling in summer season without snow. This transportation device 1 enables the user to cover a certain distance comfortably standing on the footboards 10*a* and 10*b*. And this device is small and does not occupy much space, and is safe and employs the control lever that enables the user to operate the brake and the engine easily. Therefore, it can be widely used as a transportation means and the like of one person or a small number of people who move in a certain area of places such as an amusement park, an airport building, and the like.

Although the transportation device explained above equipped with the engine, this invention can be applied to a transportation device having as a drive a motor operated by electric power supply such as a battery, and other type of driving device not limited to an engine which burns liquid fuel. In addition, the transportation device described above has the frame body which is a combination of the pipe-shaped shafts and the frame, but the transportation devices have a plate-like members like a deck frame, just like a skateboard with an engine, and other type frame are also included in this invention. Furthermore, this invention can be applied not only to a stand-on transportation device but also to a transportation device having a frame body on which a seat is put. This invention is also applicable to a transportation device on which a plurality of persons can ride as well as to a transportation device for one person. The brake system of this invention is highly effective to a transportation device dose not have a drive device, also.

The transmission path is not limited to the one described in the above. This invention can be applied to a transportation device having a transmission path using a drive shaft, and the like, instead of a driving belt. And it is possible to omit the one-way clutch in the transmission path. It is also possible to dispense with the centrifugal clutch and to use an equivalent control device.

As set forth above, the transportation device according to this invention has the brake device that is released when the control lever is held. Thus the brake device can be used to stop the transportation device and as a parking brake. The transportation device according to this invention is safe because it does not start unless the control lever is operated. It is possible to make sure that the brake always works. If the user, while running the transportation device in a wasteland and the like, is thrown out of the transportation device and releases the control lever, the brake functions automatically and the engine output decreases. Thus the transportation device can be stopped without fail, and dose not run uncontrollably. According to this invention, it is possible to provide the transportation device which can run on a flat surface, an ascending slope, and a rough road, and which enables the rider to enjoy running safely.

I claim:

1. A transportation device comprising:

a plurality of wheels placed in front and in rear;

a frame body supported by said wheels on which at least one rider rides;

a drive device that drives at least one of said wheels;

a brake device which controls a speed of at least one of said wheels; and a control lever which controls both said drive device and said brake device and actuation of the control lever releases the brake device and accelerates the drive device and release of the control lever activates the brake device and decelerates the drive device.

2. A transportation device according to claim 1, wherein said brake device is provided in said transmission path.

3. A transportation device according to claim 2, wherein said transmission has a one-way clutch disposed on the side of said drive device with respect to said brake device.

4. A transportation device according to claim 2, wherein said control lever governs said drive device, and the number of revolutions of said drive device increases when said control lever is held.

5. A transportation device according to claim 4, wherein said transmission has a centrifugal clutch disposed on the side of said drive device with respect to said brake device.

6. A transportation device according to claim 1, wherein said frame body has at least one footboard and the user steers said transportation device by weight shifting.

7. A transportation device according to claim 1, further comprising a flexible member extending above said frame body and said control lever is supported by said flexible member.

8. A transportation device comprising:

a plurality of wheels placed in front and in rear;

a frame body supported by said wheels on which at least one rider rides;

a brake device which controls a speed of at least one of said wheels;

a control lever which controls said brake device and said brake device is released when said control lever is held; and a drive device that drives at least one of said wheels through a transmission, wherein said brake device is provided in said transmission path.

9. A transportation device comprising:

a plurality of wheels placed in front and in rear;

a frame body supported by said wheels on which at least one rider can ride;

a brake device which controls a speed of at least one of said wheels;

a control lever which controls said brake device and said brake device is released when said control lever is held; and wherein said frame body has at least one footboard and the user steers said transportation device by weight shifting.

10. A transportation device comprising:

a plurality of wheels placed in front and in rear;

a frame body supported by said wheels on which at least one rider can ride;

a brake device which controls a speed of at least one of said wheels;

a control lever which controls said brake device and said brake device is released when said control lever is held; and a flexible member extending above said frame body and said control lever is supported by said flexible member.

* * * * *